US006338616B1

(12) United States Patent
Englund

(10) Patent No.: US 6,338,616 B1
(45) Date of Patent: Jan. 15, 2002

(54) SCREW ROTOR COMPRESSOR HAVING A MOVABLE WALL PORTION

(75) Inventor: Arnold Englund, Spånga (SE)

(73) Assignee: Lysholm Technologies AB, Stockholm (SE)

( * ) Notice: Subject to any disclaimer, the term of this patent is extended or adjusted under 35 U.S.C. 154(b) by 0 days.

(21) Appl. No.: 09/529,616

(22) PCT Filed: Mar. 3, 1999

(86) PCT No.: PCT/SE99/00305

§ 371 Date: Apr. 13, 2000

§ 102(e) Date: Apr. 13, 2000

(87) PCT Pub. No.: WO99/50560

PCT Pub. Date: Oct. 7, 1999

(30) Foreign Application Priority Data

Mar. 31, 1998 (SE) ..... 9801137

(51) Int. Cl.[7] ..... F04C 18/16; F04C 29/08
(52) U.S. Cl. ..... 418/201.2
(58) Field of Search ..... 418/201.2

(56) References Cited

U.S. PATENT DOCUMENTS

| | | | | |
|---|---|---|---|---|
| 2,547,169 A | * | 4/1951 | Paget | 418/201.2 |
| 3,527,548 A | | 9/1970 | Kocher et al. | 417/310 |
| 3,759,636 A | | 9/1973 | Schaefer et al. | 417/310 |
| 4,119,392 A | | 10/1978 | Breckheimer | 418/21 |
| 4,744,734 A | | 5/1988 | Sowards | 417/440 |
| 4,799,865 A | | 1/1989 | Oscarsson | 417/440 |
| 4,993,923 A | | 2/1991 | Daeyaert | 417/310 |

FOREIGN PATENT DOCUMENTS

| | | |
|---|---|---|
| DE | 26 58 047 A | 6/1978 |
| EP | 0 484 885 A | 5/1992 |
| WO | WO 96/38670 | 12/1996 |

* cited by examiner

*Primary Examiner*—John J. Vrablik
(74) *Attorney, Agent, or Firm*—Frishauf, Holtz, Goodman, Langer & Chick, P.C.

(57) ABSTRACT

A screw rotor compressor is provided that includes two mutually coacting helical screw rotors and a rotor housing (1). The housing (1) includes a first end wall (2) and a second end wall (3) and a barrel wall (7, 11) that interconnects the end walls. The housing (1) has internally the shape of two mutually intersecting cylinders and the first end wall (2) includes an inlet opening (19). The barrel wall (7, 11) includes an outlet opening (6) adjacent the second end wall (3), and also includes a further opening (9) which extends from the outlet opening (6) towards the first end wall (2) and widens over the two mutually intersecting cylinders of the internal shape of the housing. The housing (1) also includes a movable or displaceable part (11) which coacts with the further opening (9) and which engages the housing in a first position so as to form the two mutually intersecting cylinders of the internal shape of the housing, and which is not in engagement with said housing and distanced from said further opening (9) in a second position. The compressor also includes a maneuvering device for placing the movable part (11) selectively in its first or its second position. The maneuvering device is adapted to actuate a rotatable shaft (12) which is either mounted on the compressor or firmly fixed relative thereto and which is connected to said movable part (11) through the medium of a connecting element (17).

31 Claims, 3 Drawing Sheets

SCREW ROTOR COMPRESSOR HAVING A MOVABLE WALL PORTION

The present invention relates to a screw compressor that includes two mutually coacting helical screw rotors housed in a rotor housing. The housing includes first and second end walls that are interconnected by a barrel wall. The housing has an internal configuration that corresponds to two mutually intersecting cylinders and the first end wall includes an inlet opening while the barrel wall includes an outlet opening adjacent the second end wall and further includes an opening which extends from the outlet opening towards the first end wall and widens over both cylinder surfaces. The housing also includes a movable part which coacts with said further opening and which in a first position engages the housing such as to form the mutually intersecting cylindrical surfaces and which in a second position is out of engagement with the housing and therewith spaced from said further opening. The compressor includes a maneuvering device for selective positioning of the movable part either in its first or in its second position.

BACKGROUND OF THE INVENTION

With respect to compressors of this kind it is necessary in many applications to supply compressed working fluid intermittently. In order to avoid the use of complicated, and therewith expensive solutions in respect of these applications, for instance the use of a coupling device or clutch mechanism between the compressor and its drive means, or to avoid the activation and deactivation of said drive means, compressors of this kind are normally provided with means which allow the compressor to idle during those periods when compressed fluid is not required. This is usually achieved by opening a free connection between the high pressure side of the compressor and its low pressure side for return of the working fluid.

Such arrangements are described, for instance, in U.S. Pat. Specification Nos. 3, 527, 548, 3, 759, 636, 4, 119, 392, 4, 799, 865 and 4, 993, 923.

The compressor thus taught by U.S. Pat. No. 3, 527, 548 has hollow axles or shafts whose interiors communicate with the outlet through one opening, and with the inlet.

This opening can be closed by a pressure actuated valve against the force of a spring that functions to hold the valve open.

The compressor taught by U.S. Pat. No. 3, 759, 636 includes in its high pressure end section a valve which can be opened against an oil pressure through the medium of the outfeed pressure together with a pull spring, said oil pressure acting in the direction opposite to said outfeed pressure. The valve opens a connection between the compressor outlet and compressor inlet.

The compressor taught by U.S. Pat. No. 4, 119, 392 teaches a female rotor which is shorter than the distance between the end walls and which can be moved axially by a piston that either seals against the high pressure end-wall at full load or leaves a gap to the high pressure end-wall so as to bring the high pressure side into fluid connection with the inlet via the rotor grooves so as to provide an idling facility.

U.S. Pat. No. 4, 799, 865 teaches a compressor that includes an axially movable endwall at the high pressure end. The end wall is held closed by springs and can be lifted by a piston, or plunger, so as to relieve the load on the compressor.

Finally, U.S. Pat. No. 4, 993, 923 teaches a pressure actuated slide valve that is disposed around the high pressure end of each rotor shaft, said valve providing fluid connection between outlet and inlet when open.

A compressor that includes two mutually coacting screw rotors and used as an engine supercharger is known from U.S. Pat. Specification U.S. Pat. No. 4, 744, 734. Arranged at the end of the outlet passageway of this compressor is a disc-shaped throttle valve. The throttle disc is fixed in a shaft that can rotate about its long axis. The compressor also includes a bypass passageway which has connection with the compressor inlet. Two openings in the housing connects the by-pass with the rotor housing over one of the rotors, and throttle valves pivotally mounted in said passageway function to close and open said connection. Resilient arms fastened in the throttle valve shaft cause the pivotal throttle valves to either close or open the two openings in response to corresponding rotation of the shaft. When the two openings are closed in response to rotation of said shaft, the outlet passageway is opened by the valve disc, and vice versa.

The European Patent Application EP-A2-0 484 885 teaches a screw rotor compressor having an inlet at one end and a movable piston in the other axial end of the compressor housing, adjacent the outlet. The piston moves generally perpendicularly to the axes of the screw rotors. Maximum compression is obtained, when the piston is situated closest to the rotors. The size of the outlet opening increases as the piston is moved away from this position, so as to obtain lower compression.

One drawback with this latter compressor is that it cannot be made sufficiently compact to suit many purposes. The movable piston by means of which the degree of compression obtained with the compressor is adjusted must have a significant length in its axial direction. It must be possible to move the piston towards and away from a position of abutment in relation to the rotors without sticking or jamming. The forces acting on the piston from the working chamber of the compressor vary and are greatest adjacent 5 the outlet.

Another drawback is that the piston may not rotate about its own axis when moved axially in order to change the compression ratio of the compressor. Because the piston is situated above both rotors, any such rotation would cause the piston to come into contact with the rotors and therewith damage the same.

SUMMARY OF THE INVENTION

One object of the present invention is to eliminate the drawbacks of the solution described in the European Patent Application with respect to changing the compression ratio in a compressor.

Another object of the invention is to provide a novel and improved method of short-circuiting the working fluid with respect to idling of a compressor.

Still another object of the invention is to provide a simple reliable compressor where the requirements on valve tolerances are low with respect to adjusting the compression ratio.

These objects have been achieved in accordance with the present invention by means of a compressor that includes a modification in which an operating device or maneuvering device functions to actuate a rotatable shaft which is mounted on the compressor or firmly fixed relative thereto and which is firmly connected to a movable part of the compressor barrel through the medium of a connecting element.

Because the valve plate, i.e. the movable part of the barrel wall, is rotatable about an axis, it can be readily rotated out of engagement with the barrel wall and distanced from the rotors. This rotation opens the closed working chambers of the compressor, therewith immediately relieving the compressor of load. The production of compressed fluid is changed immediately, either in one step or ceases almost entirely. When the movable part extends from the outlet opening to the opposite end wall, or preferably terminates a short distance from said wall, all working chambers will come immediately into fluid connection with each other when the movable part is lifted or distanced from abutment with the stationary part of the barrel wall. Losses due to backflow or reflux are reduced to a minimum. Consequently, the movable part need only move to a very small extent in order to provide idling conditions. Only one simple maneuvering device is required to obtain this movement, for instance a motor or a spring which acts on the shaft in some appropriate manner. In one embodiment of the present invention, the opening in which the valve plate is disposed terminates short of the first end wall so that a certain degree of compression will be obtained even when the valve cover is not in engagement with the barrel housing.

Another important advantage afforded by the present invention is that the movable part can be fixed through the medium of a connecting element in said shaft. Because the connecting element has a broad and long abutment area with said shaft, the movable part will be positioned exactly in its intended place in the compressor housing in engagement with the barrel housing, and will lie in the vicinity of the rotors with only a small amount of clearance therebetween and in the absence of further guide elements.

Attachment of the connecting element on the movable part and in the shaft including bores whose diameters are larger than the diameters of the screws or other fasteners used, the shaft may be positioned at a wrong angle without any negative effect on the valve function.

Although the movable part can be arranged anywhere in the barrel wall, the placement of said movable part perpendicular to the intersection plane of the cylinders is preferred, since this provides a through-passing connection with the grooves of both rotors.

The compressor housing is made of a metallic material, for example aluminum. The movable part, however, can be made of some other material, for example a polymeric material.

Preferred embodiments of the invention are made apparent in the depending claims.

BRIEF DESCRIPTION OF THE DRAWINGS

The invention will now be described in more detail with reference to the accompanying drawings, in which.

DETAILED DESCRIPTION

Figure 1:
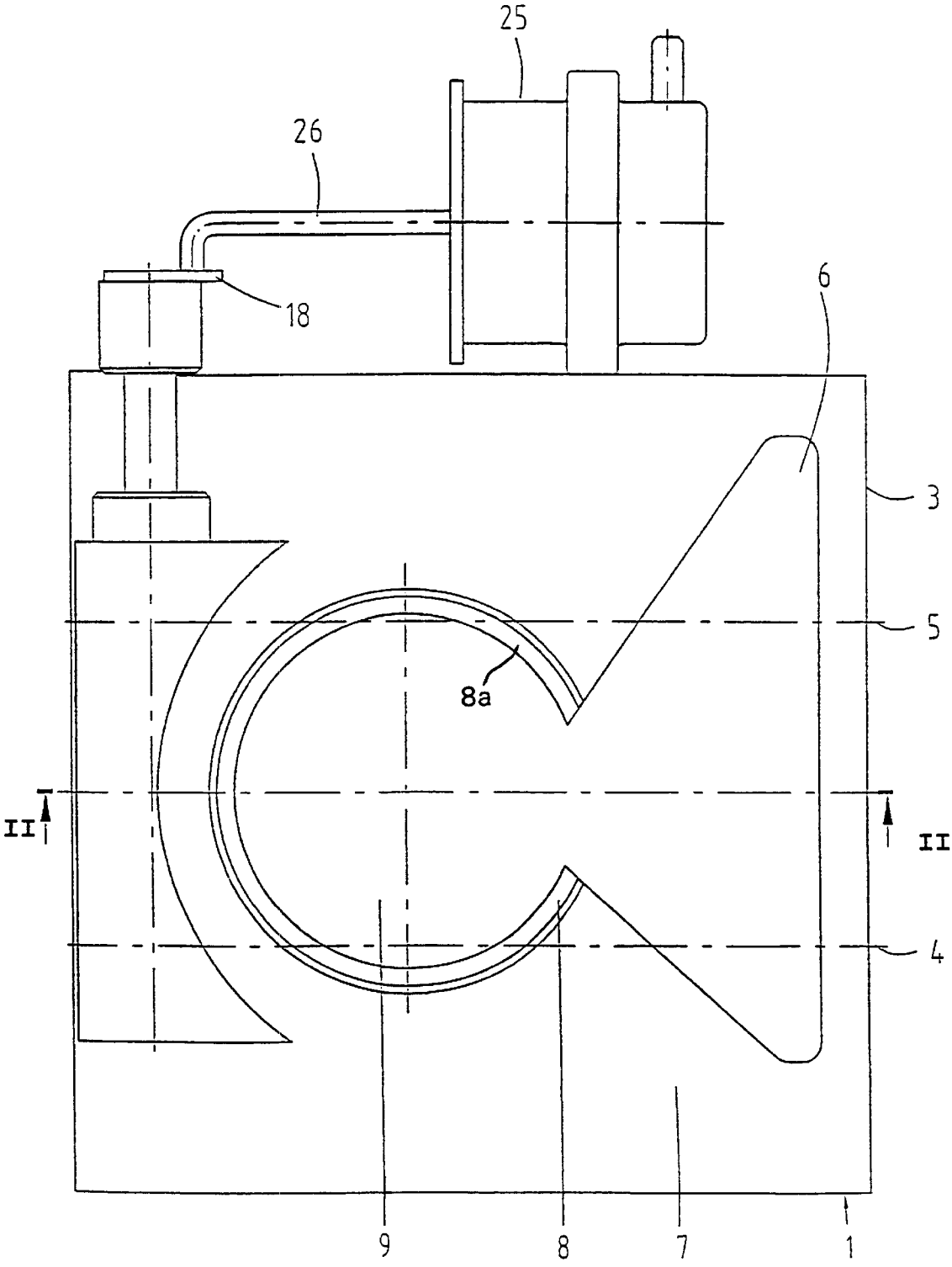
FIG. 1 illustrates schematically an inventive compressor from above, wherewith a part that is movable relative to the barrel housing is omitted.
Figure 2:
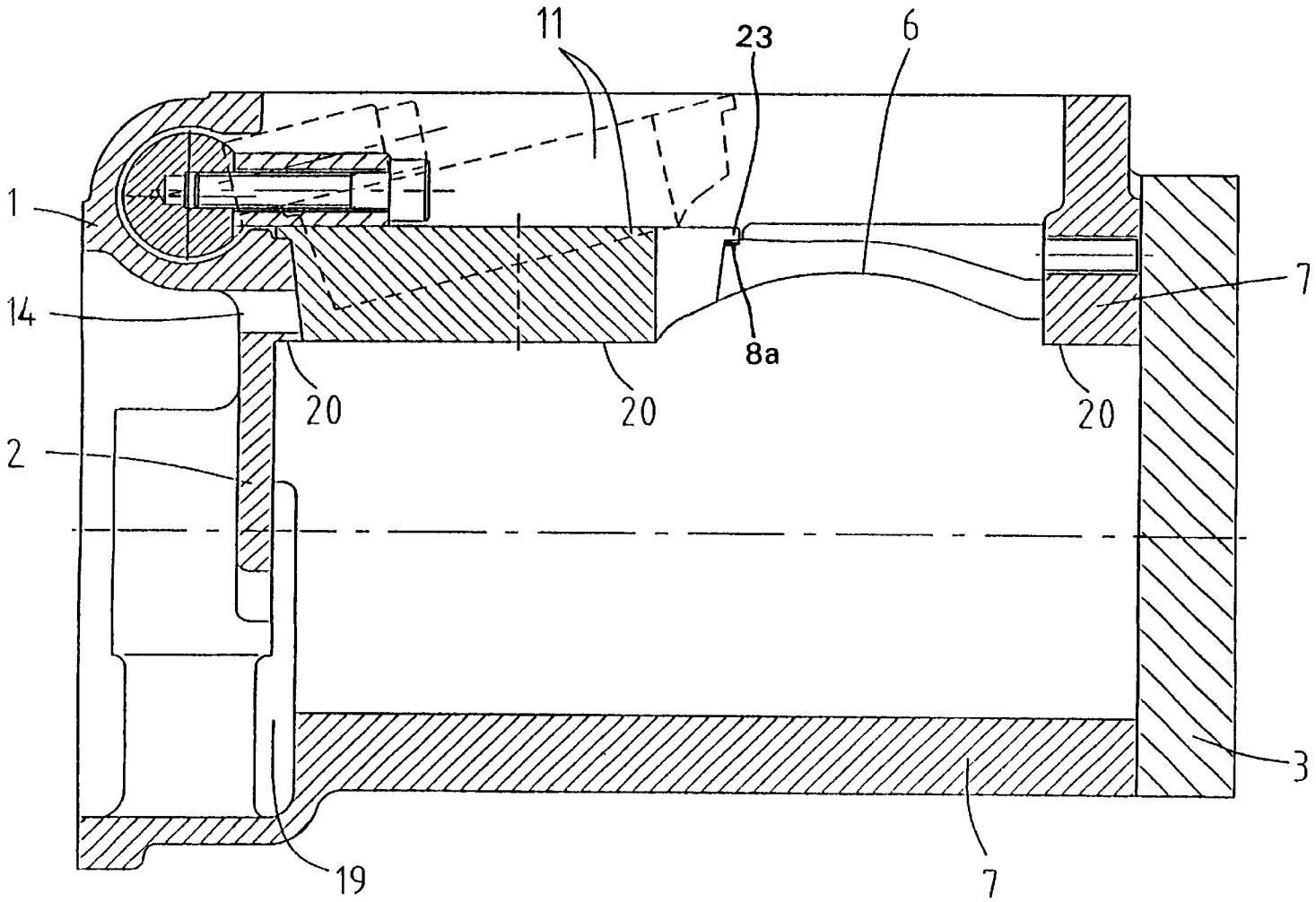
FIG. 2 is a vertical section II—II through the compressor shown in FIG. 1, through its cusps, and shows the part omitted in FIG. 1 in place in a first end position, and shows a second end position of said part in broken lines.

The compressor illustrated in FIGS. 1 and 2 includes a housing I which has a first end wall 2 that includes an inlet opening 19 on its inlet side (low pressure side) and a second end wall 3 on its outlet side (high pressure side), and a barrel wall 7, 11 which interconnects said end walls 2, 3. The barrel wall 7 has provided therein a generally triangular outlet opening 6, with the base of the triangle lying adjacent the second end wall 3. The barrel wall comprises two parts, a first stationary main part 7 and a second movable part 11, this latter part being shown in FIGS. 2 and 3 and is best seen from FIG. 3. The barrel wall 7 includes an opening 9, which is intended to receive the movable part 11. The movable, or displaceable, part 11 has a first end position in which it is received in the opening 9 in the barrel wall 7, as shown in full lines in FIG. 2. FIG. 2 shows in broken lines a second end position of said movable part 11, i.e. a position in which said movable part is out of engagement with the barrel wall 7.

Internally, the compressor housing 1 has the form of two mutually intersecting cylinders in which mutually coacting rotors having helical lobes are arranged. The center line of said rotors 4, 5 is indicated in broken lines in Figure I and indicated by the rotor reference signs.

In the illustrated embodiment, the opening 9 in the barrel wall 7 is circular and intersects the apex of the generally triangular outlet opening 6. The opening 9 extends towards the first end wall 7, in the illustrated case all the way to said first end wall 2, i.e. to a plane perpendicular to the rotor axes where an inlet pressure is still present.

Figure 3:
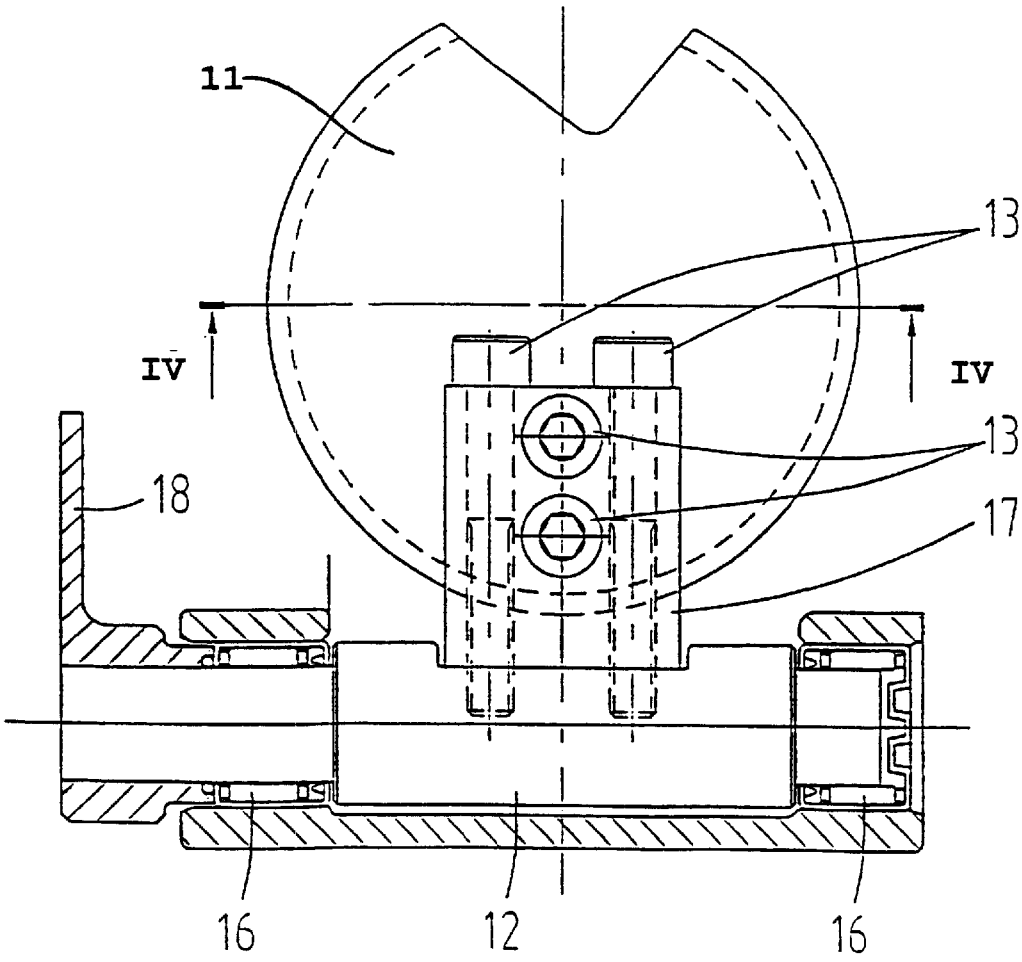
FIG. 3 shows the movable part of the barrel wall from above, with means for 5 moving said part between said two end positions.

FIG. 3 shows the movable or displaceable part II from above. As shown in the figure, the arrangement includes a connecting element 17 which connects the movable part II with a shaft 12 mounted in bearings 16. The bearings 16 are mounted in some suitable way on the stationary part 7 or on a support fixed in relation to the compressor.

One end of the shaft 12 extends beyond the bearing 16 and includes an arm 18. The arm 18 is actuated by a motor 25 or some other means (FIG. 1) through the medium of a transmission element 26, so as to cause the shaft 12 to rotate to a limited extent. This rotary movement causes the movable part II to be moved between its end positions (FIG. 2) or to positions between said end positions.

Figure 4:
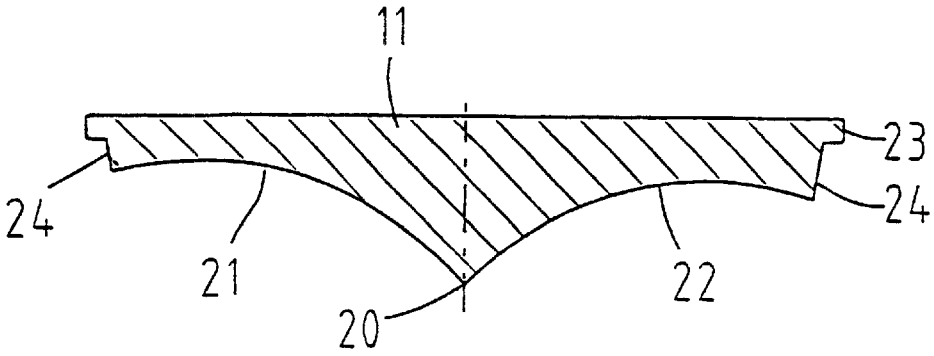
FIG. 4 is a sectional view of said movable part, taken on the line IV—IV in FIG. 3.

In the cross-sectional view IV—IV shown in FIG. 4, the movable part 11 is perpendicular to the axes of rotors 4, 5. The apex of the mantle housing, i.e. its cusp, on the movable part 11 is referenced 20 and the two areas 21 and 22 which diverge from the cusp 20 are cylindrical in shape and have the same radius of curvature as the cylinders of the stationary part 7. The movable part 11 includes a flange 23 for abutment with a corresponding recess 8 (FIGS. 1 and 2) in the barrel wall 7 around the opening 9. The circular side-area 24 of the movable part 11, intended for insertion in the opening 9 in the stationary part 7, preferably tapers conically towards the housing interior. It may alternatively be cylindrical, although in this case there must be sufficient clearance for the movable part 11 to rotate into and out of engagement with the opening 9. The conical configuration enables the movable part 11 to be inserted into the opening 9 with zero clearance, i.e. the conical surfaces may lie in mutual abutment. This means that less stringent requirements are placed on fitting precision. The circular part of the opening 9 will then either be conical or cylindrical in a corresponding manner.

In addition to the inlet passageway or opening 19, the first end wall 2 includes a connecting passageway 14 which opens out at one end into the side wall of the opening 9 and the other end of which connects with the compressor inlet. These passageways 14, 19 are both connected to the same source of working fluid. When the movable part 11 is in its one end position, in engagement with the stationary part 7, the passageway 14 is connected to said movable part 11.

In the illustrated case, the connecting element 17 has the form of a right-angled block. The shaft 12 includes a flat recess in which one end of the block is received. The connecting element 17 includes two mutually parallel bores for receiving screws 13 or like fasteners that hold the connecting element 17 in a fixed position relative to the shaft 12. Similarly, two mutually parallel further bores extend perpendicularly to the two first mentioned bores for receiving screws 13 or like fasteners that fasten the connecting element to the movable part 11. These bores have diameters that are larger than the diameters of the screws 13.

When fastening the connecting element 17 to the shaft 12 and to the movable part 11, the shaft 12 is fitted in the compressor housing and the movable part 11 is placed in its position of engagement with the opening 9. The connecting element is then fastened in the shaft 12 and in the movable part 11 with the aid of said screws. Because the diameters of the bores are larger than the diameters of the screws 13, the shaft 12 can be fitted to the compressor at a "wrong angle", both horizontally and vertically relative to the plane of the abutment area 8. This also enables vertical errors to be corrected.

A resilient covering 8*a* may be provided in the recess around the opening 9 in the barrel wall. This covering, or coating, may function as a seal and will preferably comprise a polymeric material. Such a covering or coating is preferably provided on the flange 23 of the movable part 11, which lies against the recess around the opening 9 on the barrel wall 11.

The angle through which the shaft 12 is able to rotate may be restricted either by a stop provided on the compressor or by the extent to which the maneuvering device 25 rotates the shaft 12.

When the compressor is running and compresses working fluid, the movable part 11 will be in the position shown in full lines in FIG. 2. The passageway 14 is therewith closed to passage of fluid therethrough. Working fluid, normally air, is delivered to the working chambers of the compressor through the inlet opening 19. The rotors 4, 5 mounted in the working chambers and driven by means not shown transport working fluid from the inlet opening 19 to the outlet opening 6 whilst compressing the fluid at the same time. The working fluid leaves the compressor through the outlet opening 6.

Depending on the extent to which the opening 9 widens towards the first end wall, the supply of compressed working fluid can be stopped totally or the output pressure of the exiting fluid can be lowered when bringing the movable part 11 out of engagement with the barrel wall 7. This is achieved by activating the arm 18 connected to the shaft 12 by means of said maneuvering device 25, such as to rotate the movable part 11 out of its first end position in engagement with the barrel 7 towards its second end position, shown in broken in FIG. 2. The working chambers of the compressor are therewith interconnected and short circuit the inlet and outlet via the rotor grooves or reduce the compression zone in the compressor respectively. The passageway 14 is opened at the same time. This causes the pressure in the outlet 16 to fall.

What is claimed is:

1. A screw rotor compressor comprising:

two mutually coacting helical screws rotors, a rotor housing which includes a first end wall and a second end wall, and a barrel wall connecting said end walls, wherein the housing has an internal shape of two mutually intersecting cylinders, wherein the first end wall includes an inlet opening, wherein the barrel wall includes an outlet opening adjacent the second side wall and a further opening which extends from the outlet opening towards the first end wall and widens over the two mutually intersecting cylinders of the internal shape of the housing, wherein a movable part is provided which coacts with the further opening and which in a first position engages the housing to form the two mutually intersecting cylinders of the internal shape of the housing and in a second position is out of engagement with the housing and distanced from the further opening, wherein a maneuvering device is provided for positioning the movable part selectively in either said first or said second position, and wherein the maneuvering device is adapted to actuate a rotatable shaft that is mounted on the compressor or firmly fixed relative thereto, and said rotatable shaft is connected to the movable part via a connecting element.

2. A compressor according to claim 1, wherein the rotatable shaft extends at least generally perpendicularly to an intersection plane of said cylinders of the internal shape of the housing.

3. A compressor according to claim 1, wherein the movable part has a circular cross-section in circumferential parts thereof that do not border on the outlet opening.

4. A compressor according to claim 3, wherein the movable part has a shape of a truncated cone.

5. A compressor according to claim 3, wherein the movable part has a flange which abuts the barrel wall when said movable part is in the first position.

6. A compressor according to claim 5, wherein a sealing coating or covering is provided in a region of the barrel wall against which the movable part abuts in the first position.

7. A compressor according to claim 1, wherein the further opening extends up to said first end wall.

8. A compressor according to claim 1, wherein the connecting element has a first planar surface that abuts with said movable part, a second planar surface which extends perpendicular to the first planar surface and which abuts a planar recess provided in the rotatable shaft and extending parallel to a center line of said rotatable shaft.

9. A compressor according to claim 8, wherein the movable part is adapted to be fixedly connected to the connecting element after being placed in the first position on a surface of the barrel wall.

10. A compressor according to claim 8, wherein the movable part is adapted to be fixedly connected to the rotatable shaft after being placed in the first position on a surface of the barrel wall.

11. A compressor according to claim 2, wherein the movable part has a circular cross-section in circumferential parts thereof that do not border on the outlet opening.

12. A compressor according to claim 11, wherein the movable part has a shape of a truncated cone.

13. A compressor according to claim 11, wherein the movable part has a flange which abuts the barrel wall when said movable part is in the first position.

14. A compressor according to claim 4, wherein the movable part has a flange which abuts the barrel wall when said movable part is in the first position.

15. A compressor according to claim 12, wherein the movable part has a flange which abuts the barrel wall when said movable part is in the first position.

16. A compressor according to claim 13, wherein a sealing coating or covering is provided in a region of the barrel wall against which the movable part abuts in the first position.

17. A compressor according to claim 14, wherein a sealing coating or covering is provided in a region of the barrel wall against which the movable part abuts in the first position.

18. A compressor according to claim 15, wherein a sealing coating or covering is provided in a region of the barrel wall against which the movable part abuts in the first position.

19. A compressor according to claim 2, wherein the further opening extends up to said first end wall.

20. A compressor according to claim 3, wherein the further opening extends up to said first end wall.

21. A compressor according to claim 11, wherein the further opening extends up to said first end wall.

22. A compressor according to claim 4, wherein the further opening extends up to said first end wall.

23. A compressor according to claim 12, wherein the further opening extends up to said first end wall.

24. A compressor according to claim 5, wherein the further opening extends up to said first end wall.

25. A compressor according to claim 13, wherein the further opening extends up to said first end wall.

26. A compressor according to claim 14, wherein the further opening extends up to said first end wall.

27. A compressor according to claim 15, wherein the further opening extends up to said first end wall.

28. A compressor according to claim 6, wherein the further opening extends up to said first end wall.

29. A compressor according to claim 16, wherein the further opening extends up to said first end wall.

30. A compressor according to claim 17, wherein the further opening extends up to said first end wall.

31. A compressor according to claim 18, wherein the further opening extends up to said first end wall.

* * * * *